US007799981B1

(12) United States Patent
Curet Troche

(10) Patent No.: US 7,799,981 B1
(45) Date of Patent: Sep. 21, 2010

(54) DRUM HAVING AUXILIARY SOUND BOARDS

(75) Inventor: Daniel Loran Curet Troche, 7800C Stenton Ave., Philadelphia, PA (US) 19118

(73) Assignee: Daniel Loran Curet Troche

( * ) Notice: Subject to any disclaimer, the term of this patent is extended or adjusted under 35 U.S.C. 154(b) by 0 days.

(21) Appl. No.: 12/387,952

(22) Filed: May 11, 2009

(51) Int. Cl.
*G10D 13/02* (2006.01)

(52) U.S. Cl. ..... 84/411 R; 84/414

(58) Field of Classification Search ..... 84/411 R, 84/414; D17/22
See application file for complete search history.

(56) References Cited

U.S. PATENT DOCUMENTS

| | | | | | |
|---|---|---|---|---|---|
| D174,401 | S | * | 4/1955 | Lira | D17/22 |
| D190,060 | S | * | 4/1961 | Gardner | D9/538 |
| D258,134 | S | * | 2/1981 | Widener | D17/22 |
| 5,095,796 | A | * | 3/1992 | Genna | 84/414 |
| 5,583,307 | A | * | 12/1996 | Tobia, Jr. | 84/411 R |
| 6,172,289 | B1 | * | 1/2001 | Shelley | 84/411 R |
| D442,985 | S | * | 5/2001 | Liao | D17/22 |
| D571,851 | S | * | 6/2008 | Myers | D17/22 |
| 7,429,698 | B2 | * | 9/2008 | Pickens | 84/411 R |
| 7,488,882 | B2 | * | 2/2009 | Curet Troche | 84/411 R |
| 7,601,901 | B2 | * | 10/2009 | Payerl | 84/411 R |
| 7,687,697 | B2 | * | 3/2010 | Ognibeni | 84/291 |
| 7,692,083 | B2 | * | 4/2010 | Aspland | 84/415 |
| 2008/0034944 | A1 | * | 2/2008 | Aspland | 84/415 |
| 2008/0271588 | A1 | * | 11/2008 | van der Meulen | 84/411 R |
| 2009/0019985 | A1 | * | 1/2009 | Casanta | 84/411 R |

* cited by examiner

*Primary Examiner*—Jeffrey Donels
*Assistant Examiner*—Robert W Horn

(57) ABSTRACT

An elongate drum augments sound through the use of varying cross-sectional shapes and dimensions, sound boards, and a cochlear-shaped horn.

13 Claims, 3 Drawing Sheets

Fig. A
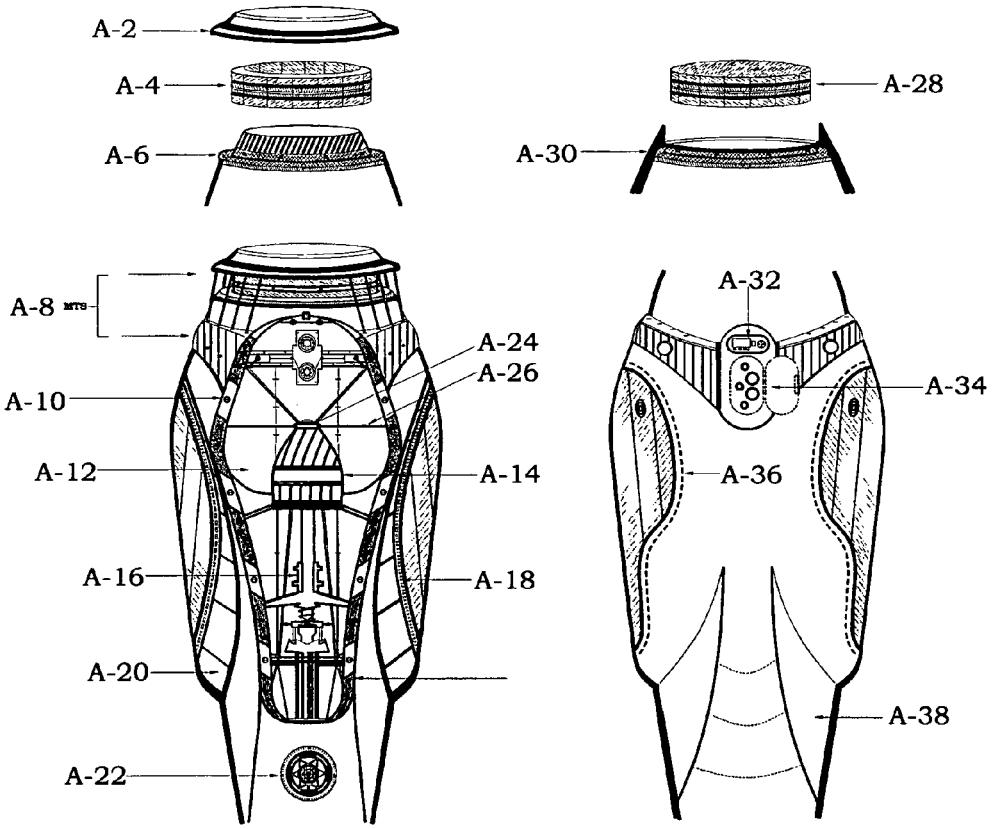
INVENTOR

Fig. B
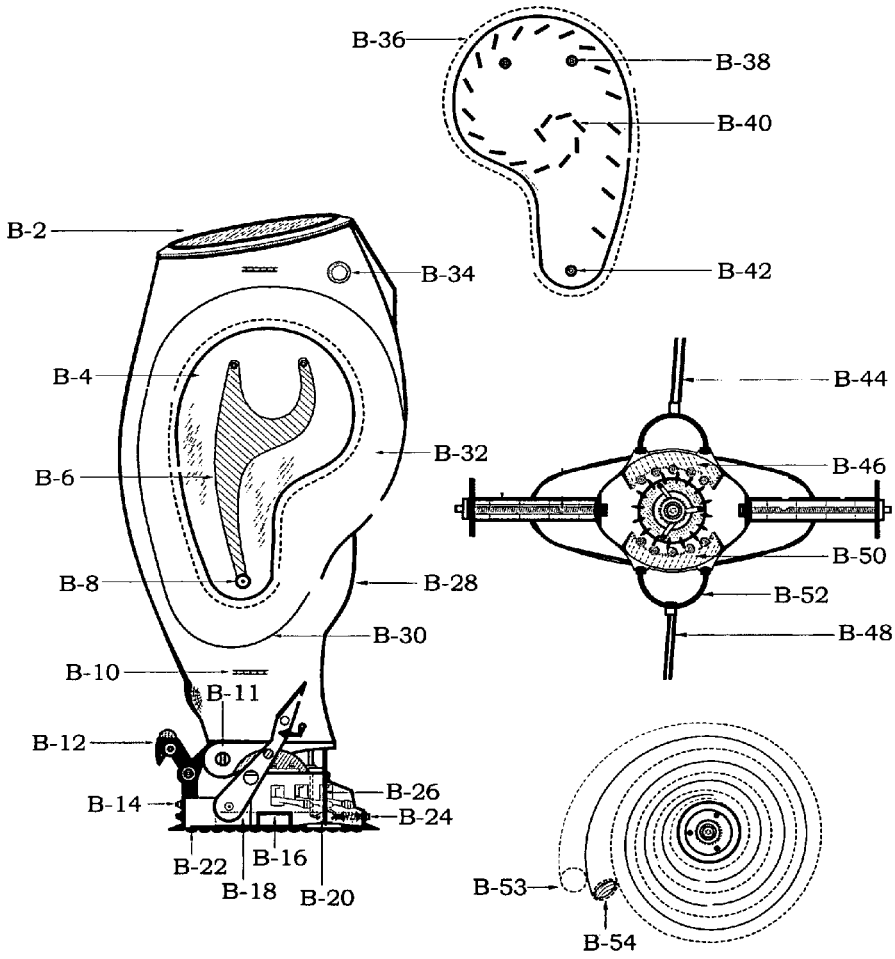
INVENTOR

Fig.C
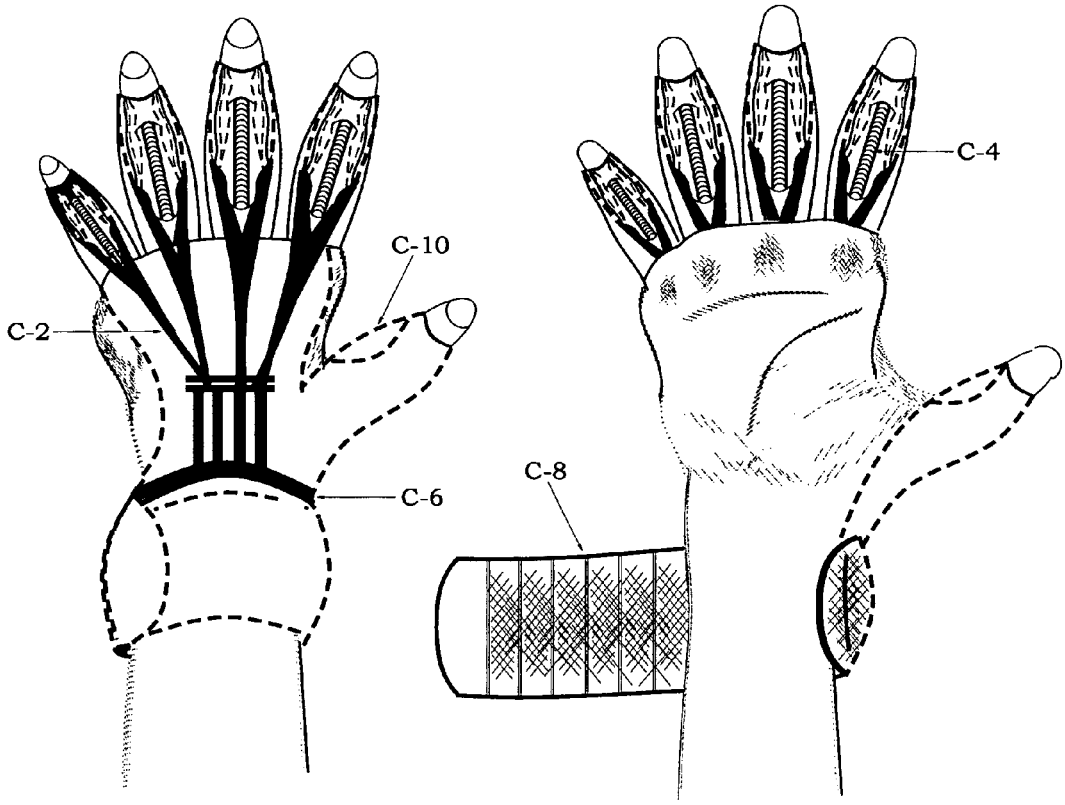
*INVENTOR*

DRUM HAVING AUXILIARY SOUND BOARDS

BACKGROUND OF THE INVENTION

This invention pertains to musical instruments and serves most particularly as an improvement on a drum in particular the drums by the trade name "Acousticonga" & "Electro-conga".

RELATED ART

| U.S. Provisional Applications | | |
|---|---|---|
| 61/126,666 | May 2008 | Curet Troche |

| U.S. Pat. Documents | | |
|---|---|---|
| 1,755,569 | April 1930 | Strupe |
| 1,845,625 | February 1932 | Robison |
| 3,008,367 | November 1961 | Parsons |
| 3,188,687 | June 1965 | Blair |
| 3,290,979 | December 1966 | Glass et al. |
| 3,685,389 | August 1972 | Bemben |
| 4,048,895 | September 1977 | May |
| 4,112,807 | September 1978 | Quibell |
| 5,610,350 | March 1997 | Miller |
| 6,441,286 | August 2002 | Brando et al. |
| 7,288,707 | October 2007 | Swinkels |
| 2008/0034944 | February 2008 | Aspland |
| 2008/0083317 | April 2008 | Payerl |
| 2008/0121088 | May 2008 | Curet Troche |
| 2008/7488882 | February 2009 | Curet Troche |

| Foreign Patent Documents | | |
|---|---|---|
| 3332 | ., 1810 | GB |

| Other References |
|---|
| Sebastian Erard, biography, inventor of the pedal harp in 1810, http://www.pianorestaurateur.nl/erard.sub.--biografie.htm, viewed Dec. 14, 2007. cited by examiner. |
| Pianoforte, reference to Sebastian Erard, Encyclopedia Britannica, published 1907 by the Werner, Company, Akron, Ohio., p. 83. cited by examiner. |
| Harp History, Double Action Harp description, invented in 1810 by Sebastian Erard, p. 2; also photo of a rare Erard Freres (brothers) harp, showing pedals for note changing, http://www.vanderbiltmusic.com/harp.sub.--history.php, viewed Dec. 14, 2007. cited by examiner. |

BRIEF SUMMARY OF THE INVENTION

This improved drum (trade name "Kingtumba") creates a drum with an improved sound, improved ground stability, and allows for easier workmanship inside drum. The sound is amplified by soundboards, a bridge as applicable to any sound board, and a new drum shell shape. Wooden rings (trade name "Head Ring") further improve sounds often not present in synthetically made instruments, due to the absence of natural wood grains. The ground stability of the drum, potentially hindered by percussion of the instrument, is improved by inclusion of a frog clamp, or pro-arm alike, at the base of the drums, minimizing unwanted movements. Horizontal orientation of adjustable springs, built within the Control House, with an external control apparatus, allow room for use of larger springs providing more or less tension as needed for better stability. Easier workmanship inside the instrument is provided by way of a work door as well as a work light reflected upward into the drum shell. A location is also available for attachment of acoustic sound effects percussion apparatuses. The Control House is built with an enclosed Digital Synthesizer, out connectors, Universal Serial (USB) connectors and built in memory to allow for a broader range of sounds and internal/external electronic communications. There is also a built in microphone and an instrument case tailored to this drum shell shape.

Hand gloves (trade name "Hard Hand") made for use with the drum, will provide more ease in playing the drum and will serve to prevent hand injuries. These improvements along with other minor details will be further described in the following detailed descriptions.

BRIEF DESCRIPTION OF THE DRAWINGS

Figure A: Front view/Rear view

A2—drumhead, A4—head ring, A6—head frame, A8—MTS case protector, A10—screws for work door, A12—work door, A14—gear case, A16—electrical pick—up, A18—sound board cloth, A20—Rip, A22—Horn, A24—Nut, A26—Nut poles, A28—Multifunctional head ring, A30—head frame for multifunctional head ring, A32—tuner "aiclave", A34—controller protector, A36—thick edges to prevent from touching sound board when in the sitting position, A38—curves for improved sound collection and delivery Figure B: Side view/top view B2—Built in wooden head with oval shape, B4—soundboard, B6—metal board, B8—sound post, B10—handles, B11—frog clam, B12—built in microphone, B14—jack socket, B16—MIDI, B18—RE21: component for providing electricity, B20—Synthesizer padding, B22—soft, protective material to minimize unwanted sounds, B24—linear adjustable shocks, B26—Digital synthesizer pole, B28—Shell dynamic shape, B30—Rip, B32—belly of shell, B34—connection for acoustic sound effects, B36—Inside view of soundboard, B38—nut openings, B40—spiral braces, B42—sound post opening, B44—Right side sound post, B46—Right sided wooden bridge, B48—Left side sound post, B50—Left sided wooden bridge, B52—sound post fork, B53—circular horn shape, B54—elliptical horn shape Figure C: Gloves C2—elastic material, C4—firm, inflexible material, C6—stitches, C8—wrist strap, C10—thumb padding

DETAILED DESCRIPTION OF THE INVENTION

This improved drum shell is partly elliptical, partly spiral, partly oval in shape with different diameters throughout its length. The body and bottom portion of the shell near the end opposite the drumhead is elliptical. Toward the top portion where the drumhead is located, the drum shell shape begins to take on a more oval shape. The middle and top portion of the shell, closest to the drum head has a diameter approximately twice the distance of the width. The lowest portion of the drum shell closest to the end opposite the drumhead continues to be elliptical but of a smaller diameter. One could describe the overall shape as the shape of a heart with the top wider portion being the base and the lower thinner portion being the apex (Figure A and B). There is a wooden sound board on either side of the outer drum shell, with each said soundboard having the overall shape of a spiral (B40). The said soundboards sandwich the inner drum framework. Sound posts extend across the inside, between the soundboards and bridges, extending out to the drum shell (B44-50). This allows for amplification of sound waves produced by the strings and drumhead vibrations. The opposite positioning of the sound posts (B44-50) avoids wave cancellations. Stability plates (Figure B, top view) travel from the outer shell into the center and around the backbone of the striker action (Figure A) taking the same elliptical shape as the outer shell where it meets with the bridges. There are two wooden bridges divided by right and left hemispheres where the strings rest and travel through (Figure B, top view). Metal plates (B6) on the outer part of the soundboards help to maintain the stress created by the wood's forced shape. These plates evenly deliver vibrations from the sound posts throughout the soundboards since the strings are tuned evenly, in contrast to most string instruments which are "low and high" tuned within one single bridge.

The striker action (Figure A) mentioned above is a mechanism which serves to snap, pull and strike the musical strings causing string vibration. Adjustable shock absorbers (B24) serve to allow downward movement of the drum shell and central framework with every percussion strike of the drumhead. Upon downward movement of the drum shell the striker head of the striker action which is partially stabilized on a backbone, directly strikes the strings after a series of other sequential movements. Applied pressure from compressed springs above the striker action allow rotational motion to occur with enough force to cause vibration of adjacent strings. Each striker head also serves to dampen the sound immediately after striking the string by remaining on the string. This prevents over-resonance of string vibration. The striker action is now surrounded by a bridge. The shape of the bridge is also elliptical according to the shell shape. The utility of this overall shape is to better collect and deliver sound waves compared to the typical circular shape. Just below the striker action is a horn, shaped like, but not limited to the cochlea. The drumhead also has a wooden ring included below the drumhead and encased within the drum shell. This wooden ring gives the drum the classic wooden percussion sound despite the use of a synthetic drum shell. It can be used with covered side up or covered side down allowing for different percussion sounds upon percussion of the drumhead.

The stability of the drum is improved by way of a frog-clamp or pro-arm which serves to absorb movement, preventing the drum from bouncing excessively in a disorderly manner during percussion of the drumhead. The drum has a set of carrying handles and a carrying case, one for each drum size available but not limited to one size. The drums have different lengths and widths, therefore they also have specific carrying cases for their individual size and shape. A light which reflects into the drum shell will be available for lighting the inside of the drum. A digital synthesizer/musical instrument digital interface (MIDI) allows for production of enhanced sounds and data communication to accompany drum percussion.

In addition, due to stress on the hands from drumhead percussion, a set of hand gloves (trade name "Rock Hand") serve to protect the hands, in particularly the wrist and the digits, from trauma (Figure C). They also serve to make percussion more efficient requiring less physical effort. The gloves are made of different combined materials including partially elastic and partially breathable material. Firm, inflexible, natural or man made material covers the palmar and dorsal aspects of the digits. Elastic material surrounds the lateral aspect of the digits eventually traversing the dorsal portion of the metacarpal phalangeal joints. The elastic ultimately attaches to a wrist strap serving as a single flexible unit.

The invention claimed is:

1. A percussion musical instrument comprising:

an elongate drum shell, the drum shell having a first end and a second end and a hollow interior;

a drum head or wooden head for percussion covering the first end of the shell;

one or more sound boards suspended outward of the surface of the shell, to provide for amplification of sound from the shell or the interior of the shell.

2. The percussion musical instrument as claimed in claim 1, further comprising:

a base for placement on the floor to support the instrument;

an attachment between the drum shell and the base in the form of a frog clamp, or pro-arm configured to tightly attach the drum shell to the base to minimize unwanted movements.

3. The percussion musical instrument as claimed in claim 1, further comprising:

auxiliary components inside the hollow interior of said shell; and a work door providing an entry into the inner portion of said shell.

4. The percussion musical instrument as claimed in claim 1, further comprising:

rattle-like sound makers, Chekere (beads), bells, or jingles attached to the percussion instrument.

5. The percussion musical instrument as claimed in claim 1, further comprising:

a multifunctional head ring mounted near the drum head.

6. The percussion musical instrument as claimed in claim 5, wherein the head ring is circular.

7. The percussion musical instrument as claimed in claim 5, wherein the head ring is made of solid wood.

8. The percussion musical instrument as claimed in claim 5, wherein the head ring is made of staves.

9. The percussion musical instrument as claimed in claim 1, further comprising:

at least one sound post interfacing the soundboards for amplification of sound waves.

10. The percussion musical instrument as claimed in claim 1, further comprising:

a sound cavity in the shell enclosing a horn shaped like the cochlea of the inner human ear.

11. The percussion musical instrument as claimed in claim 1, further comprising:

auxiliary electronic sound producing apparatuses inside the hollow interior of shell including a control house with a synthesizer, a digital interface, and USB ports.

12. The percussion musical instrument as claimed in claim 1, further comprising:

shell supports that support the shell on a surface;

adjustable shock absorbers on the drum shell supports for adjustments of the sound according to different percussion depths.

13. The percussion musical instrument as claimed in claim 11, further comprising:

a synthesizer/musical instrument digital interface (MIDI).

* * * * *